US009520090B2

(12) United States Patent
Yun et al.

(10) Patent No.: US 9,520,090 B2
(45) Date of Patent: Dec. 13, 2016

(54) ELECTROWETTING DISPLAY APPARATUS HAVING LOW POWER CONSUMPTION AND METHOD OF DRIVING THE SAME

(71) Applicant: Samsung Electronics Co., Ltd., Suwon-Si, Gyeonggi-Do (KR)

(72) Inventors: Young-jun Yun, Seongnam-si (KR); Jung Woo Kim, Hwaseong-si (KR); Myoung-hoon Jung, Seoul (KR)

(73) Assignee: Samsung Electronics Co., Ltd., Gyeonggi-do (KR)

( * ) Notice: Subject to any disclaimer, the term of this patent is extended or adjusted under 35 U.S.C. 154(b) by 125 days.

(21) Appl. No.: 13/922,405

(22) Filed: Jun. 20, 2013

(65) Prior Publication Data

US 2014/0152641 A1 Jun. 5, 2014

(30) Foreign Application Priority Data

Dec. 3, 2012 (KR) ..... 10-2012-0139265

(51) Int. Cl.
*G09G 3/34* (2006.01)

(52) U.S. Cl.
CPC ..... *G09G 3/348* (2013.01); *G09G 2300/0819* (2013.01); *G09G 2300/0861* (2013.01); *G09G 2310/061* (2013.01); *G09G 2380/02* (2013.01)

(58) Field of Classification Search
CPC ... G02B 3/14; G02B 26/005; G02B 2207/115; G09G 3/19; G09G 3/38; G09G 3/348; G09G 3/344; G09G 3/3433
USPC ..... 345/49, 87–104, 107, 211–213; 359/270
See application file for complete search history.

(56) References Cited

U.S. PATENT DOCUMENTS

2005/0287392 A1* 12/2005 Toyoda ..... 428/690
2007/0247417 A1* 10/2007 Miyazaki et al. ..... 345/107
2008/0224970 A1 9/2008 Van Den Biggelaar et al.
2009/0046082 A1* 2/2009 Jacobson et al. ..... 345/204
2009/0103159 A1* 4/2009 Cheng et al. ..... 359/228
2010/0079436 A1* 4/2010 Komatsu ..... G09G 3/344 345/211
2010/0201657 A1* 8/2010 Miyazaki ..... 345/205
2010/0302615 A1* 12/2010 Aubert et al. ..... 359/290
2011/0187696 A1* 8/2011 Slack et al. ..... 345/211
2011/0221726 A1* 9/2011 Huitema ..... 345/209
2012/0086693 A1* 4/2012 Izumi et al. ..... 345/211
2012/0162269 A1 6/2012 Bohn et al.
(Continued)

FOREIGN PATENT DOCUMENTS

JP 2010204665 A 9/2010
JP 5062583 B2 10/2012

*Primary Examiner* — Sanghyuk Park
(74) *Attorney, Agent, or Firm* — Harness, Dickey & Pierce, P.L.C.

(57) ABSTRACT

An electrowetting display apparatus includes an electrowetting pixel configured to display an image. The electrowetting pixel includes a polar liquid and a nonpolar liquid arranged between a common electrode and a pixel electrode; and a driving circuit configured to control operations of the electrowetting pixel. The driving circuit includes a memory circuit configured to store an image to be displayed by the electrowetting pixel. The driving circuit is further configured to periodically provide a reset signal to the electrowetting pixel while the electrowetting pixel is displaying the image and provide an image stored in the memory circuit to the electrowetting pixel after the electrowetting pixel cell resets.

18 Claims, 3 Drawing Sheets

(56) References Cited

U.S. PATENT DOCUMENTS

| | | | | |
|---|---|---|---|---|
| 2013/0057940 | A1* | 3/2013 | Jo et al. | 359/290 |
| 2013/0063409 | A1* | 3/2013 | Chiu et al. | 345/211 |
| 2013/0222355 | A1* | 8/2013 | Choi et al. | 345/211 |
| 2013/0301106 | A1* | 11/2013 | Jon et al. | 359/290 |

* cited by examiner

ELECTROWETTING DISPLAY APPARATUS HAVING LOW POWER CONSUMPTION AND METHOD OF DRIVING THE SAME

CROSS-REFERENCE TO RELATED APPLICATIONS

This application claims the benefit of Korean Patent Application No. 10-2012-0139265, filed on Dec. 3, 2012, in the Korean Intellectual Property Office, the disclosure of which is incorporated herein in its entirety by reference.

BACKGROUND

1. Field

The present disclosure relates to electrowetting display apparatuses and methods of driving the same.

A. 2. Description of the Related Art

A phenomenon in which a shape of liquid droplets is changed when a voltage is applied to liquid droplets is referred to as electrowetting. Using this electrowetting phenomenon, for example, there have been developed electrowetting lenses capable of electrically changing a focus length or electrowetting scanners capable of electrically changing a refraction angle of the lens.

An electrowetting display apparatuses makes use of the electrowetting phenomenon. Electrowetting display apparatuses have a structure in which oil colored by one of red, green, blue, and black for each pixel is arranged on a hydrophobic insulating film. In such electrowetting display apparatuses, a hydrophobic insulating film (e.g., an insulation film that resists mixture with water) is changed into a hydrophilic insulating film (e.g., an insulation film that is soluble with water), thereby collecting the oil in one side when voltages are applied to respective pixels and the oil evenly spread out when voltages are not applied.

If a white reflective plate is disposed on a rear surface of an electrowetting display apparatus, a pixel is tinged with white when applying a voltage that causes the oil to collect is applied thereto. In contrast, a pixel is tinged with a color of the colored oil when a voltage is not applied.

Also, electrowetting display apparatuses may be manufactured as a transmissive type using a backlight unit to produce light and also as a reflective type using external light. Reflective electrowetting display apparatuses may have excellent visibility in the open air where sunlight is strong, may consume a small amount of power, and may have excellent color saturation of natural colors because of coloring oil by using dyes. Accordingly, electrowetting display apparatuses can be applied to flexible electronic paper.

SUMMARY

Provided are electrowetting display apparatuses having an improved aperture ratio and reduced power consumption by preventing backflow of a nonpolar liquid.

Provided are methods for driving electrowetting display apparatuses to prevent backflow of a nonpolar liquid by using low power consumption.

Additional aspects will be set forth in part in the description which follows and, in part, will be apparent from the description, or may be learned by practice of the presented embodiments.

According to an example embodiment, electrowetting display apparatus includes an electrowetting pixel configured to display an image and a driving circuit. The electrowetting pixel includes a polar liquid and a nonpolar liquid arranged between a common electrode and a pixel electrode. The driving circuit is configured to control operations of the electrowetting pixel, the driving circuit including a memory circuit configured to store an image to be displayed by the electrowetting pixel. The driving circuit is configured to periodically provide a reset signal to the electrowetting pixel while the electrowetting pixel is displaying the image and provide an image stored in the memory circuit to the electrowetting pixel after a reset is finished.

For example, the driving circuit may include a first transistor including a drain connected to a data line and a gate connected to a gate line, a second transistor including a gate connected to a source of the first transistor and a source connected to the pixel electrode of the electrowetting pixel, a capacitor having a first end and a second end. The first end connected to the first transistor and the second transistor and the second end connected to ground, a third transistor including a gate connected to a reset line and a source and a drain connected to the pixel electrode and the common electrode of the electrowetting pixel, respectively, and a fourth transistor including a source connected to a drain of the second transistor such that the fourth transistor is connected to the second transistor in series.

Also, a gate of the fourth transistor may be connected to a reset bar line that is configured to provide a signal opposite to a signal provided to the reset line.

A drain of the fourth transistor may be grounded.

The apparatus may further include a gate driver providing a gate signal to the gate line, a data driver providing an image signal to the data line, and a clock generator configured to generate a first signal and a second signal, and provide the first signal, as the reset signal, to the reset line and provide the second signal to the reset bar line, the first signal being an inverse of the second signal and the first and second having a desired period.

The clock generator may be configured to determine the desired period such that the electrowetting pixel receives the reset signal for at least an amount of time required for the nonpolar liquid to return to a state where the nonpolar liquid is evenly spread.

Also, the electrowetting pixel may include a rear substrate and a front substrate disposed facing each other, the pixel electrode disposed on a top surface of the rear substrate, a hydrophobic insulating film disposed on the pixel electrode, the nonpolar liquid disposed on the hydrophobic insulating film, the common electrode disposed on a bottom surface of the front substrate, and the polar liquid filling a vacant space between the front substrate and the rear substrate.

For example, the front substrate and the rear substrate may be transparent substrates.

As another example, the front substrate may be a transparent substrate and the rear substrate may be a white reflective plate.

Also, the polar liquid may be a transparent liquid and the nonpolar liquid may be colored with a color.

According to another example embodiment, a method of driving an electrowetting display apparatus includes displaying an image by an electrowetting pixel by applying a fixed voltage to a common electrode of the electrowetting pixel and applying a variable voltage to a pixel electrode of the electrowetting pixel according to an image signal, storing the image signal in a memory circuit included in a driving circuit of the electrowetting pixel; and resetting, by the driving circuit, the electrowetting pixel by periodically providing a reset signal from the driving circuit to the electrowetting pixel while the electrowetting pixel is displaying the image and providing the image signal stored in the memory circuit to the electrowetting pixel after the electrowetting pixel resets.

The method may further include storing the image signal in the capacitor by turning on the first transistor by applying a first voltage via the gate line and providing the image signal via the data line.

The method may further include, while the first voltage is being applied via the gate line, turning off the third transistor by applying a second voltage via the reset line, and turning on the fourth transistor by applying the first voltage via the reset bar line, wherein the first voltage is greater than the second voltage.

The method may further include resetting the electrowetting pixel by turning off the first transistor, turning on the third transistor and simultaneously turning off the fourth transistor. The turning off the first transistor includes applying the second voltage to the gate of the first transistor via the gate line, the turning on the third transistor includes applying the first voltage to the gate of the third transistor via the reset line, and the turning off the fourth transistor includes applying the second voltage to the gate of the fourth transistor via the reset bar line.

The providing the image signal may further include providing, after the electrowetting pixel resets, the image signal stored in the capacitor to the electrowetting pixel by turning off the third transistor and turning on the fourth transistor. The turning off the third transistor includes applying the second voltage to the gate of the third transistor via the reset line, and the turning on the fourth transistor includes applying the first voltage to the gate of the fourth transistor via the reset bar line.

In one embodiment, the turning on the third transistor and simultaneously turning off the fourth transistor may be repeated a number of times within a desired period.

In one embodiment, the turning on the third transistor and simultaneously turning off the fourth transistor are performed by providing, via a clock generator, the reset line and the reset bar line with mutually opposite signals that both having the desired period.

BRIEF DESCRIPTION OF THE DRAWINGS

These and/or other aspects will become apparent and more readily appreciated from the following description of the embodiments, taken in conjunction with the accompanying drawings of which.

DETAILED DESCRIPTION

Figure 1:
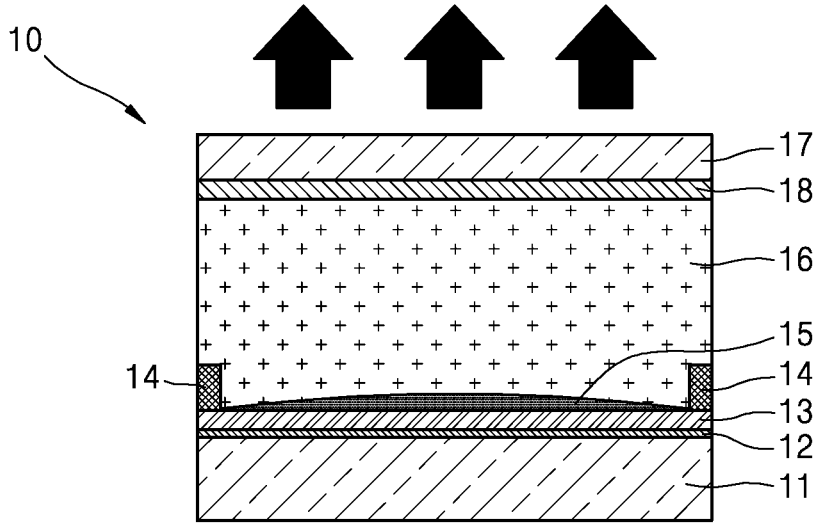
FIGS. 1 and 2 are schematic cross-sectional views illustrating a structure and operations of one electrowetting pixel of an electrowetting display apparatus according to an example embodiment.

Reference will now be made in detail to example embodiments, examples of which are illustrated in the accompanying drawings, wherein like reference numerals refer to the like elements throughout. In the drawings, a size of an element may be exaggerated for clarity and convenience of description and the thicknesses of layers and regions may be exaggerated for clarity. Like reference numerals in the drawings denote like elements.

Detailed illustrative embodiments are disclosed herein. However, specific structural and functional details disclosed herein are merely representative for purposes of describing example embodiments. Example embodiments may be embodied in many alternate forms and should not be construed as limited to only those set forth herein.

It should be understood, however, that there is no intent to limit this disclosure to the particular example embodiments disclosed. On the contrary, example embodiments are to cover all modifications, equivalents, and alternatives falling within the scope of the invention. Like numbers refer to like elements throughout the description of the figures.

It will be understood that, although the terms first, second, etc. may be used herein to describe various elements, these elements should not be limited by these terms. These terms are only used to distinguish one element from another. For example, a first element could be termed a second element, and, similarly, a second element could be termed a first element, without departing from the scope of this disclosure. As used herein, the term "and/or," includes any and all combinations of one or more of the associated listed items.

It will be understood that when an element is referred to as being "connected," or "coupled," to another element, it can be directly connected or coupled to the other element or intervening elements may be present. In contrast, when an element is referred to as being "directly connected," or "directly coupled," to another element, there are no intervening elements present. Other words used to describe the relationship between elements should be interpreted in a like fashion (e.g., "between," versus "directly between," "adjacent," versus "directly adjacent," etc.).

The terminology used herein is for the purpose of describing particular embodiments only and is not intended to be limiting. As used herein, the singular forms "a," "an," and "the," are intended to include the plural forms as well, unless the context clearly indicates otherwise. It will be further understood that the terms "comprises," "comprising," "includes," and/or "including," when used herein, specify the presence of stated features, integers, steps, operations, elements, and/or components, but do not preclude the presence or addition of one or more other features, integers, steps, operations, elements, components, and/or groups thereof.

It should also be noted that in some alternative implementations, the functions/acts noted may occur out of the order noted in the figures. For example, two figures shown in succession may in fact be executed substantially concurrently or may sometimes be executed in the reverse order, depending upon the functionality/acts involved.

Various example embodiments of the present invention will now be described more fully with reference to the accompanying drawings in which some example embodiments of the invention are shown. In the drawings, the thicknesses of layers and regions are exaggerated for clarity.

Figure 2:
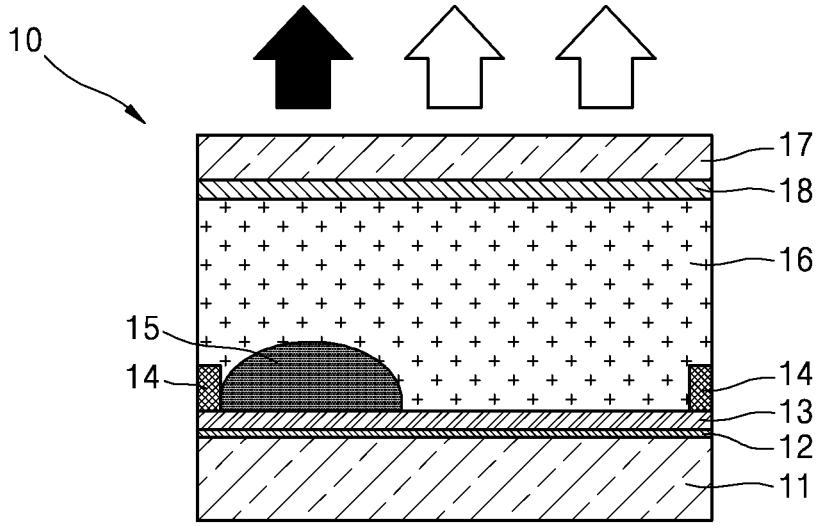

FIGS. 1 and 2 are schematic cross-sectional views illustrating a structure and operations of a plurality of electrowetting pixels 10 of an electrowetting display apparatus according to an example embodiment. For the sake of brevity, only one of a plurality of electrowetting pixels 10 of the electrowetting display apparatus is shown.

Referring to FIGS. 1 and 2, the electrowetting pixel 10 of the electrowetting display apparatus may include a rear substrate 11 and a front substrate 17 facing each other, a pixel electrode 12 disposed on a top surface of the rear substrate 11, a hydrophobic insulating film 13 disposed on the pixel electrode 12, a nonpolar liquid 15 disposed on the hydrophobic insulating film 13, a vertical partition 14 vertically projected on the rear substrate 11 to distinguish pixels, a common electrode 18 disposed on a lower surface of the front substrate 17, and a polar liquid 16 filling the inside of a space between the front substrate 17 and the rear substrate 11.

In a transmissive type electrowetting display apparatus, both the rear substrate 11 and the front substrate 17 may be transparent substrates. In a reflective type electrowetting display apparatus, the front substrate 17 may be a transparent substrate and the rear substrate 11 may be a white reflective plate.

The common electrode 18 disposed on the bottom surface of the front substrate 17 is commonly connected to the plurality of electrowetting pixels 10 of the electrowetting display apparatus, and a regularly fixed voltage is applied to the common electrode 18. The pixel electrode 12 may be individually disposed for each of the plurality of electrowetting pixels 10, and a voltage applied to the pixel electrode 12 may be a variable voltage varying with a desired color and a gray level.

The nonpolar liquid 15 is a liquid having no polarity such as oil and may be colored by dyes of red, green, blue, and black. The nonpolar liquid 15 is surrounded by the partition 14 inside the electrowetting pixel 10 and is disposed on the hydrophobic insulating film 13. The polar liquid 16 has a transparent liquid having polarity may use one of deionized (DI) water, a liquid obtained by dissolving another polarizable material in the DI water, and ethylene glycol glycerin (EGG). Since a top surface of the partition 14 is separated from the front substrate 17, the polar liquid 16 may fill throughout the plurality of electrowetting pixels 10.

If the electrowetting pixel 10 is in an OFF state, in which there is no potential difference between the pixel electrode 12 and the common electrode 18, that is, when the same voltage is applied to the pixel electrode 12 and the common electrode 18, the nonpolar liquid 15 spread out on the hydrophobic insulating film 13 to cover the entire the hydrophobic insulating film 13. In this case, the electrowetting pixel 10 is tinged with the same color as that of the nonpolar liquid 15. For example, a voltage applied to the common electrode 18 may be fixed at +15 V and a voltage of about +15 V may be applied to the pixel electrode 12 in the OFF state On the contrary, in an ON state, a voltage applied to the pixel electrode 12 is changed, thereby generating a potential difference between the pixel electrode 12 and the common electrode 18. For example, while the voltage applied to the common electrode 18 is fixed with +15V, a voltage of up to about −15 V may be applied to the pixel electrode 12 according to a gray level in the ON state. When the electrowetting display device turns to the ON state, due to an electric field generated between the pixel electrode 12 and the common electrode 18, a surface of the hydrophobic insulating film 13 is changed to a hydrophilic state.

As shown in FIG. 2, when the electrowetting display device is in the ON state and the hydrophobic insulation layer 13 becomes hydrophilic, the nonpolar liquid 15 is swept away to a corner and the polar liquid 16 is dispersed onto the surface of the hydrophobic insulating film 13 changed into being hydrophilic. Accordingly, the electrowetting pixel 10 transmits or reflects light. For example, when the rear substrate 11 is a transparent substrate and a backlight unit (not shown) is disposed below the rear substrate 11, light emitted from the backlight unit passes through the electrowetting pixel 10. Alternatively, when the rear substrate 11 is a white reflective plate, the rear substrate 11 reflects external light and the electrowetting pixel 10 is tinged with white. In this case, according to the intensity of a voltage applied to the pixel 12, a degree of sweeping the nonpolar liquid 15 may be changed.

However, in the electrowetting pixel 10 of the electrowetting display apparatus, when the potential difference between the pixel electrode 12 and the common electrode 18 is continuously maintained, for example, when the electrowetting pixel 10 continuously display white, there occurs a phenomenon in which the nonpolar liquid 15 collected to the corner due to the hydrophobic insulating film 13 changed into hydrophilic spreads out again due to a backflow of the nonpolar liquid 15.

This backflow is generated because ions penetrate into the polar liquid 16 due to an effect of the electric field formed between the pixel electrode 12 and the common electrode 18, and thus the nonpolar liquid 15 is charged. When the nonpolar liquid 15 is charged, an electric force acts between the pixel electrode 12 and the common electrode 18 and then the nonpolar liquid 15 covers the surface of the hydrophobic insulating film changed into being hydrophilic, resulting in a reduction of the reflectivity or transparency of the electrowetting pixel cell 10. For example, a voltage applied to the common electrode 18 is fixed as +15 V and a voltage of −15 V is continuously applied to the pixel electrode 12.

Figure 3:
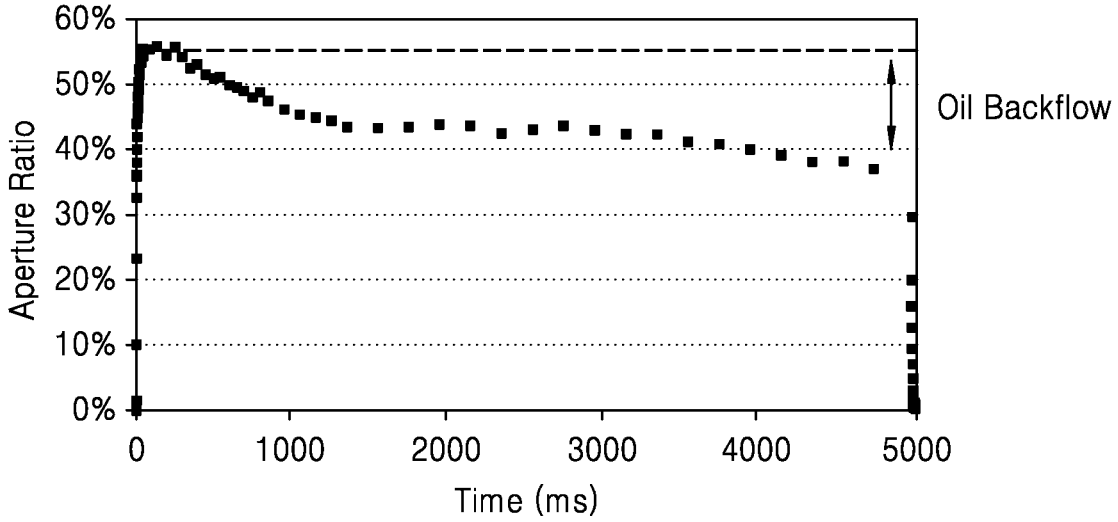
FIG. 3 is a graph illustrating a decline of reflectance of an electrowetting pixel due to backflow of a nonpolar liquid.

FIG. 3 is a graph confirming that due to the backflow, reflectance of the electrowetting pixel 10 gradually decreases over time. Particularly, when the electrowetting display apparatus is a reflective type, since the reflectivity of the electrowetting pixel 10 may factor in determining the quality of a display apparatus, it may be advantageous to effectively restrain the backflow phenomenon.

Figure 4:
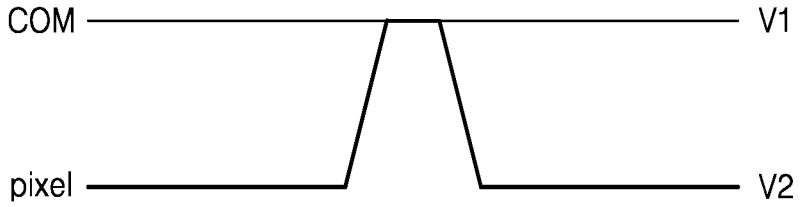
FIG. 4 is a timing chart illustrating voltages applied to a common electrode and a pixel electrode of an electrowetting pixel to prevent backflow of a nonpolar liquid.

To suppress such backflow phenomenon, as schematically shown in FIG. 4, the same voltage is periodically applied to both the pixel electrode 12 and the common electrode 18, thereby periodically discharging the nonpolar liquid 15. When the electric field disappears between the pixel electrode 12 and the common electrode 18, the ions penetrating into the nonpolar liquid 15 naturally exit from the nonpolar liquid 15 via the polar liquid 16, thereby discharging the nonpolar liquid 15.

A reset operation of removing the ions penetrating into the nonpolar liquid 15 may be performed between frames of images. In this operation, an image of a frame is displayed and the reset is performed and then an image of a next frame is displayed. However, since the resetting is performed sequentially between the displaying of the frames, a frame rate may be slowed as much as the time required to perform the reset. Also, power consumption of a data driver and a gate driver scanning the electrowetting pixels 10 to perform the reset operations increases, thereby increasing power consumption. Accordingly, it may be more effective to reset without individual reset sections and without using the gate driver and the data driver.

Figure 5:
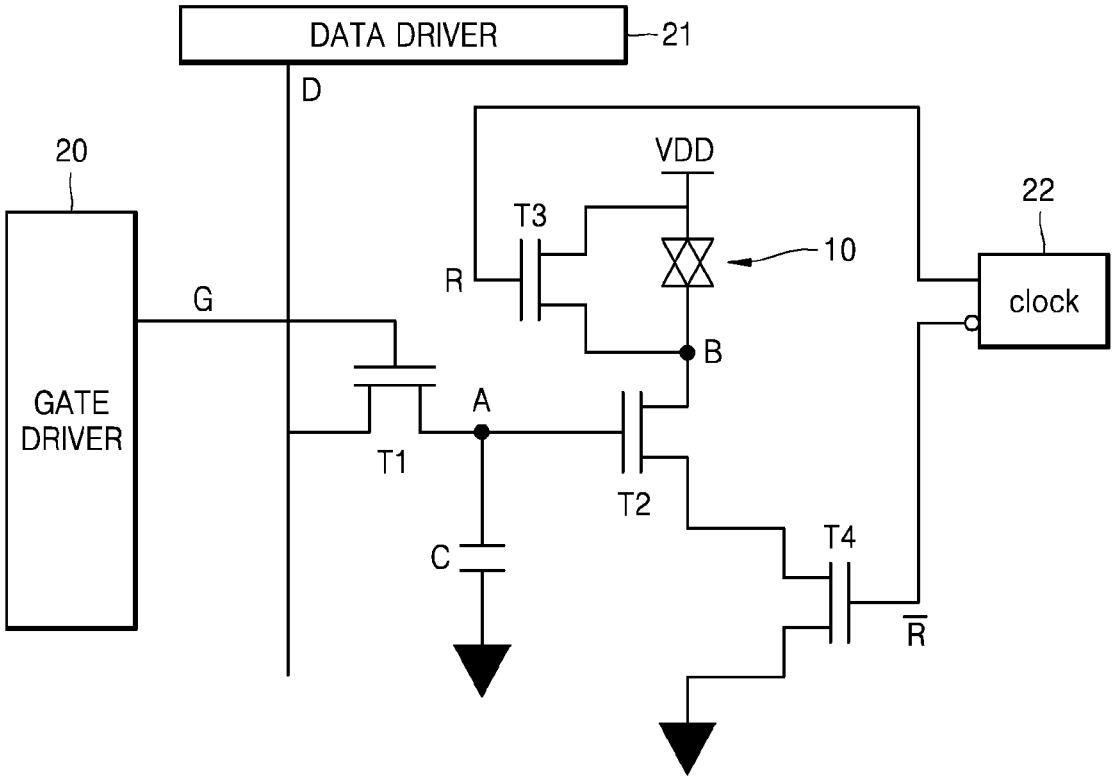
FIG. 5 is a circuit view illustrating an example driving circuit of the electrowetting display apparatus according to an example embodiment.

FIG. 5 is a circuit view illustrating a driving circuit of the electrowetting display apparatus according to an example embodiment.

Referring to FIG. 5, the driving circuit may include a first transistor T1 including a drain connected to a data line D and a gate connected to a gate line G, a second transistor T2 including a gate connected to a source of the first transistor T1 and a source connected to the electrowetting pixel 10 via the pixel electrode 12, as illustrated in FIGS. 1 and 2. The driving circuit further includes a capacitor C having one end connected to between the first transistor T1 and the second transistor T2 at a node "A" and another end connected to ground, a third transistor T3 including a gate connected to a reset line R, a source connected to the electrowetting pixel 10 via the pixel electrode 12 at a node "B" and a drain connected to the to the electrowetting pixel 10 via the common electrode 18. The driving circuit further includes a fourth transistor T4 connected to the second transistor T2 in series. For example, a source of the fourth transistor T4 may be connected to a drain of the second transistor T2. Further, a gate of the fourth transistor T4 may be connected to an inverted reset line (a reset bar line) R bar and a drain of the fourth transistor T4 may be connected to ground.

The driving circuit shown in FIG. 5 may be disposed on each of the respective electrowetting pixels 10 of the electrowetting display apparatus. Not shown, in the electrowetting display apparatus, a plurality of the electrowetting pixels 10 may be arranged in a two-dimensional matrix array, in which a plurality of gate lines G may be connected to a plurality of pixel rows in a horizontal direction and a plurality of data lines D may be connected to the plurality of pixel columns in a vertical direction. The gate line G may be connected to a gate driver 20 and may provide a gate signal for sequentially scanning the plurality of pixel rows. The data line D may be connected to a data driver 21 and may provide signals of images to be displayed to the plurality of pixel columns, respectively. The reset line R may provide reset signals to the respective electrowetting pixels 10, and the reset bar line R bar may provide signals opposite to the reset signals to the respective electrowetting pixels 10. The reset line R may be connected to a non-inverted output of an individual clock generator 22 and the reset bar line R bar may be connected to an inverted output of the individual clock generator 22.

Figure 6:
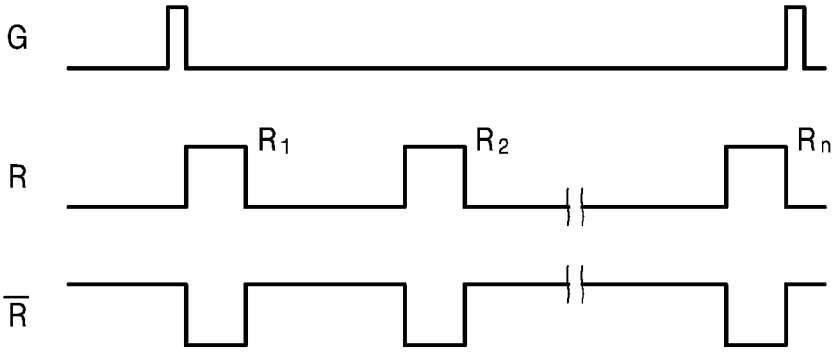
FIG. 6 is a timing chart illustrating operations of the circuit shown in FIG. 5.

FIG. 6 is a timing chart illustrating operations of the driving circuit of FIG. 5.

Referring to FIG. 6, while the electrowetting display apparatus displays an image of a frame, pixel rows may be scanned one by one and an image signal may be provided to the respective electrowetting pixels 10. For example, when providing the image signal to the electrowetting pixels 10 in an nth pixel row, a high voltage is applied to the gate of the first transistor T1 via a gate line G of the nth pixel row. Then, the first transistor T1 in the nth pixel row is turned on and the image signal may be stored in the capacitor C via the data line D. The image signal may vary, for example, with a gray level of an image displayed on the electrowetting pixel 10.

Display of a White Image

When the electrowetting pixel 10 displays a white image, the data line D may provide a high voltage (e.g. a first voltage). Then, a node designated as A becomes in a high state and in this case, the second transistor T2 is turned on. On the other hand, while the gate line G is providing the high voltage, a low voltage (e.g. a second voltage) is provided via the reset line R and the high voltage is provided via the reset bar line R bar. Then, the third transistor T3 is in an OFF state and the fourth transistor T4 becomes turned on. In this case, a node designated as B is connected to the ground and becomes in a low state. Accordingly, the electrowetting pixel 10 displays white because the nonpolar liquid 15 is swept away due to the potential difference between the pixel electrode 12 and the common electrode 18.

To provide an image signal to a next pixel row, for example, (n+1)th pixel row, a high voltage is applied to a gate line G connected to the (n+1)th pixel row and a low voltage is applied to the gate line of the nth pixel row. Then, the first transistor T1 in the nth pixel row is turned off. Though the first transistor T1 is turned off, since the capacitor C is charged, the A node is still in the high state and the second transistor T2 is maintained to be in the ON state. Accordingly, the electrowetting pixel 10 may continuously display the white image.

As described above, when the electrowetting pixel 10 continuously displays the white image, ions penetrate into the nonpolar liquid 15 and a backflow phenomenon may occur.

To prevent the backflow phenomenon, it is necessary to remove the ions in the nonpolar liquid 15 by temporarily applying the same voltage to the pixel electrode 12 and the common electrode 18. To accomplish this, while a low voltage is being applied to the gate line G, a high voltage may be provided via the reset line R and a low voltage may be provided via the reset bar line R bar. Then, the third transistor T3 is turned on and the fourth transistor T4 is turned off. Since the source of the third transistor T3 is connected to the pixel electrode 12 of the electrowetting pixel 10 and the drain of the third transistor T3 is connected to the common electrode 18 of the electrowetting pixel 10, when the third transistor T3 is turned on, the same voltage may be applied to the pixel electrode 12 and the common electrode 18. Accordingly, the electrowetting pixel 10 may be reset. While being reset, the electrowetting pixel 10 temporarily displays a black image. However, since a reset time is just several ms the black image may not be recognized by viewers.

When the reset is finished, the low voltage is provided via the reset line R and the high voltage is provided via the reset bar line R bar. Then, the third transistor T3 is turned off and the fourth transistor T4 is turned on. In this case, the B node becomes in a low state and the electrowetting pixel 10 displays white again.

Since the electrowetting pixel 10 displays an original image after the reset, the driving circuit for the electrowetting pixel 10 may be considered as to include a memory circuit that stores the original image. That is, an image to be displayed by the electrowetting pixel 10 is stored in the memory circuit of the driving circuit, the electrowetting pixel 10 temporarily displays the black image while being reset, and the image stored in the memory circuit may be provided to the electrowetting pixel 10 after the reset is finished.

As described above, according to an example embodiment, a reset operation may be performed while an image of a frame is being displayed. For example, concurrently or in parallel with display of the image. Accordingly, the reset operation may be repeated several times with certain intervals in one frame. For example, in FIG. 6, an image signal is provided to one pixel row and then a reset operation is performed n times until providing a next image signal. The reset interval may be determined to be an amount of time taken for the nonpolar liquid 15 to flow back into its natural state when no potential difference exists between the pixel electrode 12 and the common electrode 18.

According to an example embodiment, since the reset operations may be performed while displaying the image, to prevent the backflow of the nonpolar liquid 15 it is unnecessary to perform a reset operation by additionally scanning pixels between one frame and a next frame using the gate driver 20 and data driver 21. Accordingly, since the gate driver 20 and the data driver 21 are not used for the reset operation, it is possible to reduce power consumption. Since the reset line R and the reset bar line R bar may be connected to the clock generator 22, which is generally already disposed in an electronic device, it may be unnecessary to install an additional driver for the reset operation. Also, since there is no additional reset section between frames where an image is not displayed, a frame rate of the electrowetting display apparatus may be improved.

Display of a Black Image

When the electrowetting pixel 10 displays a black image, the data line D may provide a low voltage. Then, the A node becomes in a low state and the second transistor T2 is turned off. Since the second transistor T2 is turned off, the B node is disconnected from the ground. Therefore, irrelevant to signals provided to the reset line R and the reset bar line R bar, the B node is continuously maintained being in a high state. Accordingly, since the same voltage is applied to the pixel electrode 12 and the common electrode 18, the electrowetting pixel 10 may maintain the black image, irrelevant to the signals provided to the reset line R and the reset bar line R bar.

Example embodiments of the electrowetting display apparatus with an improved aperture ratio and low power consumption and the method of driving the same have been described above and illustrated in the drawings. It should be understood that the example embodiments described therein should be considered in a descriptive sense only and not for purposes of limitation. Descriptions of features or aspects within each embodiment should typically be considered as available for other similar features or aspects in other embodiments.

What is claimed is:

1. An electrowetting display apparatus comprising:

an electrowetting pixel configured to display an image, the electrowetting pixel including a polar liquid and a nonpolar liquid arranged between a common electrode and a pixel electrode; and a driving circuit configured to control operations of the electrowetting pixel the driving circuit including, a first transistor including a drain connected to a data line and a gate connected to a gate line;

a second transistor including a gate connected to a source of the first transistor and a source connected to the pixel electrode of the electrowetting pixel;

a capacitor having a first end and a second end, the first end connected to the first transistor and the second transistor and the second end connected to ground;

a third transistor including a gate connected to a reset line, a source connected to the pixel electrode and a drain connected to the common electrode; and a fourth transistor including a source connected to a drain of the second transistor such that the fourth transistor is connected to the second transistor in series.

2. The apparatus of claim 1, wherein a gate of the fourth transistor is connected to a reset bar line that is configured to provide a signal opposite to a signal provided to the reset line.

3. The apparatus of claim 2, wherein a drain of the fourth transistor is grounded.

4. The apparatus of claim 1, further comprising:

a gate driver configured to generate a gate signal and provide the gate signal to the gate line;

a data driver configured to generate an image signal and provide the image signal to the data line; and a clock generator configured to generate a first signal and a second signal, and provide the first signal, as a reset signal, to the reset line and provide the second signal to the reset bar line, the first signal being an inverse of the second signal and the first and second signal having a desired period.

5. The apparatus of claim 4, wherein the clock generator is configured to determine the desired period such that the electrowetting pixel receives the reset signal for at least an amount of time required for the nonpolar liquid to return to a state where the nonpolar liquid is evenly spread.

6. An electrowetting display apparatus comprising:

an electrowetting pixel configured to display an image, the electrowetting pixel including a polar liquid and a nonpolar liquid arranged between a common electrode and a pixel electrode; and a driving circuit including a memory circuit configured to store an image to be displayed by the electrowetting pixel, a transistor including a gate connected to a reset line, a source connected to the pixel electrode and a drain connected to the common electrode such that the same voltage is temporarily applied to the pixel electrode and the common electrode when the transistor is on, the driving circuit configured to, control operations of the electrowetting pixel, periodically reset the electrowetting pixel during a frame period by temporarily applying the same voltage to the pixel electrode and the common electrode while the electrowetting pixel is displaying an image of a frame and not to reset the electrowetting pixel between frames, and provide an image stored in the memory circuit to the electrowetting pixel after the electrowetting pixel cell resets, wherein the electrowetting pixel includes, a rear substrate and a front substrate disposed facing each other, the pixel electrode disposed on a top surface of the rear substrate, a hydrophobic insulating film disposed on the pixel electrode, the nonpolar liquid disposed on the hydrophobic insulating film, the common electrode disposed on a lower surface of the front substrate, and the polar liquid filling a vacant space between the front substrate and the rear substrate.

7. The apparatus of claim 6, wherein the front substrate and the rear substrate are transparent substrates.

8. The apparatus of claim 6, wherein the front substrate is a transparent substrate and the rear substrate is a white reflective plate.

9. The apparatus of claim 6, wherein the polar liquid is a transparent liquid and the nonpolar liquid is colored with a color.

10. A method of driving an electrowetting display apparatus, the electrowetting device including an electrowetting pixel, the electrowetting pixel including a polar liquid and a nonpolar liquid arranged between a common electrode and a pixel electrode, the method comprising:

displaying an image by applying a fixed voltage to the common electrode of the electrowetting pixel and applying a variable voltage to the pixel electrode of the electrowetting pixel according to an image signal;

storing the image signal in a memory circuit included in a driving circuit of the electrowetting pixel;

periodically resetting, by the driving circuit, the electrowetting pixel during a frame period by temporarily applying the same voltage to the pixel electrode and the common electrode while the electrowetting pixel is displaying an image of a frame; and providing the image signal stored in the memory circuit to the electrowetting pixel after the electrowetting pixel resets, wherein the electrowetting pixel is not reset between frames, and the driving circuit includes, a first transistor including a drain connected to a data line and a gate connected to a gate line;

a second transistor including a gate connected to a source of the first transistor and a source connected to the pixel electrode of the electrowetting pixel;

a capacitor having a first end and a second end, the first end connected to the first transistor and the second transistor and the second end connected to ground;

a third transistor including a gate connected to a reset line, a source connected to the pixel electrode and a drain connected to the common electrode; and a fourth transistor including a source connected to a drain of the second transistor such that the fourth transistor is connected to the second transistor in series.

11. The method of claim 10, wherein the resetting provides a reset signal having a desired period, the desired period determined such that the electrowetting pixel receives the reset signal for at least an amount of time required for a nonpolar liquid included in the electrowetting pixel to return to a state where the nonpolar liquid is evenly spread.

12. The method of claim 10, wherein a source of the fourth transistor is connected to a drain of the second transistor and a gate of the fourth transistor is connected to a reset bar line, and the method further comprises:

providing a signal to the reset bar line that is opposite to a signal provided to the reset line.

13. The method of claim 12, wherein the storing the image signal in the memory circuit comprises:

storing the image signal in the capacitor by, applying a first voltage to the gate of the first transistor via the gate line, and providing the image signal to the drain of the first transistor via the data line.

14. The method of claim 13, wherein the storing the image signal in the memory circuit further comprises:

turning off the third transistor and turning on the fourth transistor while the first voltage is applied to the gate of the first transistor via the gate line, wherein the turning off the third transistor includes applying a second voltage to the gate of the third transistor via the reset line, and the turning on the fourth transistor includes applying the first voltage to the gate of the fourth transistor via the reset bar line, the first voltage being greater than the second voltage.

15. The method of claim 14, wherein the resetting further comprises:

resetting the electrowetting pixel by turning off the first transistor, turning on the third transistor and simultaneously turning off the fourth transistor, wherein the turning off the first transistor includes applying the second voltage to the gate of the first transistor via the gate line, the turning on the third transistor includes applying the first voltage to the gate of the third transistor via the reset line, and the turning off the fourth transistor includes applying the second voltage to the gate of the fourth transistor via the reset bar line.

16. The method of claim 15, wherein the providing the image signal further comprises:

providing, after the electrowetting pixel resets, the image signal stored in the capacitor to the electrowetting pixel by turning off the third transistor and turning on the fourth transistor, wherein the turning off the third transistor includes applying the second voltage to the gate of the third transistor via the reset line, and the turning on the fourth transistor includes applying the first voltage to the gate of the fourth transistor via the reset bar line.

17. The method of claim 15, wherein the turning on the third transistor and simultaneously turning off the fourth transistor are repeated a number of times within a desired period.

18. The method of claim 17, wherein the turning on the third transistor and simultaneously turning off the fourth transistor are performed by providing, via a clock generator, the reset line and the reset bar line with mutually opposite signals that both having the desired period.

* * * * *